US010637189B1

(12) United States Patent
Ahn et al.

(10) Patent No.: US 10,637,189 B1
(45) Date of Patent: Apr. 28, 2020

(54) LOCKING APPARATUS FOR LAN CABLE

(71) Applicant: COMXI Co., Ltd., Seoul (KR)

(72) Inventors: Chang Hoon Ahn, Gyeonggi-do (KR); Yong Un Choi, Chungcheongnam-do (KR); Byong Ju Bae, Chungcheongnam-do (KR)

(73) Assignee: COMXI Co., Ltd., Seoul (KR)

( * ) Notice: Subject to any disclaimer, the term of this patent is extended or adjusted under 35 U.S.C. 154(b) by 0 days.

(21) Appl. No.: 16/414,214

(22) Filed: May 16, 2019

(30) Foreign Application Priority Data

Jan. 28, 2019 (KR) ..... 10-2019-0010441

(51) Int. Cl.
*H01R 13/627* (2006.01)
*H01R 13/42* (2006.01)
*H01R 13/639* (2006.01)

(52) U.S. Cl.
CPC ..... *H01R 13/627* (2013.01); *H01R 13/42* (2013.01); *H01R 13/639* (2013.01); *H01R 13/6397* (2013.01); *H01R 2201/04* (2013.01)

(58) Field of Classification Search
CPC ..... H01R 13/6397
See application file for complete search history.

(56) References Cited

U.S. PATENT DOCUMENTS 5,340,324 A * 8/1994 Fields ..... E05B 73/00 439/133
5,429,522 A * 7/1995 Noschese ..... H01R 13/447 439/133
6,918,782 B2 * 7/2005 Foster ..... H01R 13/6272 439/301
7,354,291 B2 * 4/2008 Caveney ..... H01R 13/6397 439/344
7,371,086 B2 * 5/2008 Yamada ..... H01R 13/6397 439/133
7,438,584 B2 * 10/2008 Caveney ..... H01R 13/6397 439/344
7,578,690 B2 * 8/2009 Caveney ..... H01R 13/6397 439/344

(Continued)

FOREIGN PATENT DOCUMENTS

KR 101475861 B1 12/2014
KR 101621454 B1 5/2016
KR 10-1925837 B1 12/2018

*Primary Examiner* — Ross N Gushi
(74) *Attorney, Agent, or Firm* — Nelson Mullins Riley & Scarboroug LLP; Kongsik Kim, Esq.

(57) ABSTRACT

The present invention relates to a locking apparatus for a LAN cable. The locking apparatus for the LAN cable includes: a connector receiving member coupled to receive a LAN port connector having a connector body, an elastic hook provided in an upper part of the connector body, and a stopping step provided in a lower part of the connector body; a locking apparatus body coupled to the connector receiving member; and a locking member disturbing operation of the elastic hook of the LAN port connector in the locking apparatus body, and movably installed to reciprocate between a locking position in which disconnecting operation of the connector receiving member and the LAN port connector is disturbed, and a unlocking position in which release operation of the elastic hook is enabled and the disconnecting operation of the connector receiving member is enabled.

8 Claims, 23 Drawing Sheets

(56) References Cited

U.S. PATENT DOCUMENTS 7,695,303 B2 * 4/2010 Chen ..... H01R 13/443 439/344
7,806,706 B2 * 10/2010 Obenshain ..... H01R 13/6395 439/133
7,892,012 B1 * 2/2011 Foung ..... H01R 13/633 439/344
7,909,625 B2 * 3/2011 Obenshain ..... H01R 13/6395 439/133
7,976,329 B2 * 7/2011 Foung ..... H01R 13/633 439/344
8,025,514 B1 * 9/2011 Wang ..... G02B 6/3897 385/56
8,038,456 B1 * 10/2011 Wang ..... G02B 6/3893 385/56
8,038,460 B2 * 10/2011 Andres ..... G02B 6/389 439/344
8,215,972 B2 * 7/2012 Wang ..... G02B 6/3897 385/56
8,308,498 B2 * 11/2012 Adams ..... G02B 6/3879 439/304
8,348,686 B1 * 1/2013 Huang ..... H01R 13/6392 439/133
8,529,284 B1 * 9/2013 Smith ..... H01R 13/6272 439/344
8,545,243 B2 * 10/2013 Lin ..... H01R 13/6397 439/133
8,632,352 B2 * 1/2014 Wagner ..... H01R 13/5812 439/352
8,845,344 B2 * 9/2014 Ishiyama ..... H01R 43/26 439/133
9,331,426 B2 * 5/2016 Adams ..... H01R 13/629
9,350,114 B2 * 5/2016 Liang ..... H01R 13/6275
9,735,506 B2 * 8/2017 Tsay ..... H01R 13/639
9,735,507 B1 * 8/2017 Liang ..... H01R 13/6397
10,069,242 B1 * 9/2018 Wen ..... H01R 13/6275
10,120,138 B2 * 11/2018 Jones ..... G02B 6/3825
2006/0089039 A1 * 4/2006 Caveney ..... H01R 13/6272 439/352
2009/0007609 A1 1/2009 Obenshain
2010/0136809 A1 6/2010 Andres et al.
2011/0317976 A1 * 12/2011 Eckstein ..... G02B 6/3825 385/139
2012/0270429 A1 10/2012 Lin
2017/0077641 A1 3/2017 Kleeberger et al.

* cited by examiner

LOCKING APPARATUS FOR LAN CABLE

CROSS REFERENCE TO RELATED APPLICATION

The present application claims priority to Korean Patent Application No. 10-2019-0010441, filed Jan. 28, 2019, which application is incorporated herein by reference.

TECHNICAL FIELD

The present invention relates generally to a locking apparatus for a LAN cable and, more particularly, to a locking apparatus for a LAN cable which can easily and securely lock a LAN port connector connected to the LAN cable when connecting the LAN port connector to a LAN port.

RELATED ART

Generally, with development of industries and technologies, the spread of electronic devices such as computers has rapidly increased. Most organizations, such as companies and government offices, use electronic devices such as server computers, personal computers (including laptops), tablet computers, and mobile devices to perform tasks, and various facilities such as machinery and factory facilities, industrial facilities, and military facilities are also controlled by the electronic devices.

As the industries have been reorganized with tasks using electronic devices having computer functions, important information leakage has often occurred by penetrating malignant codes or electronic viruses into other electronic device maliciously.

In consideration of this, various measures have been applied to prevent information leakage and protect information from penetration of electronic viruses in information offices, companies, government offices, and military facilities. However, in recent years, with development of memory devices, general-purpose USB ports have been applied to the electronic devices so that connection with computers can be easily performed within a short time. Thus, the third parties can easily access the main computer to infect the same with electronic viruses as well as extract important information.

That is, most computers on the market today have at least one general-purpose USB port, and by connecting a USB memory to the USB port, anyone can easily access the desired computer.

Therefore, countermeasures against penetration of the electronic viruses and important information leakage by easily connecting a USB memory to the computer regardless of insider or outsider have been needed.

The present applicant has filed a number of applications for locking apparatuses for USB ports, the locking apparatuses being able to prevent unauthorized memory from being connected to the USB port when a USB memory is connected to the USB port.

However, in addition to a memory, electronic devices have also been provided with a LAN port for connecting to a wired network such as the Internet and a telephone line. The LAN port to which a LAN connector connected to a LAN cable is connected can be also connected to an external electronic device or memory. Accordingly, there has been a demand for a device that can securely maintain a locked state even when a LAN port is provided.

The foregoing is intended merely to aid in the understanding of the background of the present invention, and is not intended to mean that the present invention falls within the purview of the related art that is already known to those skilled in the art.

SUMMARY

Accordingly, the present invention has been made keeping in mind the above problems occurring in the related art, and the present invention is intended to propose a locking apparatus for a LAN cable, which can easily lock or unlock a LAN port connector of the LAN cable connected to a LAN port of an electronic device.

In order to achieve the above object, according to one aspect of the present invention, there is provided the locking apparatus for the LAN cable, which includes: a connector receiving member receiving a LAN port connector to be coupled thereto, the LAN port connector having a connector body, an elastic hook provided in an upper part of the connector body, and a stopping step provided in a lower part of the connector body; a locking apparatus body coupled to the connector receiving member; and a locking member disturbing operation of the elastic hook of the LAN port connector in the locking apparatus body, and movably installed to reciprocate between a locking position in which disconnecting operation of the connector receiving member and the LAN port connector is unattainable, and a unlocking position in which release operation of the elastic hook is enabled and the disconnecting operation of the connector receiving member is enabled, wherein the locking member is provided with a key way into which an unlocking key is inserted.

Accordingly, the LAN cable connected to the LAN port is prevented from being disconnected from the LAN port so that security of the LAN port of electronic device may be improved.

Here, the locking member may include: a locking member body retracting into and coming out of the locking apparatus body, and having a movement-preventive protrusion filling a gap between the LAN port connector and the connector receiving member at the locking position; and a hook blocking part extending from the locking member body, and positioned between the elastic hook and the connector body of the LAN port connector at the locking position to block defamation of the elastic hook.

Accordingly, operation of the locking member may prevent and control the release operation of the elastic hook of the LAN port connector and the disconnecting operation of the connector receiving member of the LAN port connector at the same time.

The connector receiving member may include: a receiving part for surrounding and receiving an outside of the connector body of the LAN port connector; and a body coupling part extending from the receiving part and coupled to the locking apparatus body.

The receiving part may preferably include: opposite side walls facing each other; a pair of upper walls symmetrically connected to each other while facing each other at upper parts of the opposite side walls, and having an open part in which the elastic hook is positioned; and a pair of lower walls symmetrically connected to each other while facing each other, and spaced apart from each other to define a channel through which a cable connected to the LAN port connector passes.

Accordingly, the locking apparatus of the present invention may be easily coupled to the LAN port connector connected to the LAN port without disconnection of the LAN port connector from the LAN port.

In addition, preferably, the receiving part may further include: a stopper protruding from each of the lower walls toward an associated upper wall and stopped by the stopping step of the LAN port connector.

Accordingly, the receiving part may not be arbitrarily disconnected from the LAN port connector.

The locking apparatus body may include: an upper wall, a lower wall, opposite side walls, and an elastic locking member protruding to extend from the lower wall to the upper wall, locking the locking member by being inserted into the key way of the locking member, and unlocking the locking member by being removed from the key way by the unlocking key inserted into the key way.

In addition, preferably, between the upper wall and lower wall, a first coupling part to which the connector receiving member is coupled and a second coupling part to which the locking member is movably coupled to reciprocate may be provided.

According to the locking apparatus for the LAN cable of the present invention, the LAN port connector can be connected to or disconnected from the LAN port in a state in which the LAN port connector is connected to the LAN port.

Since operation of the elastic hook is unattainable in a connected state to the LAN port connector, the locked state can be efficiently maintained such that it is impossible to perform disconnecting operation of the LAN port connector without using an authorized unlocking means (the unlocking key).

Accordingly, security can be improved by preventing data loss or electronic virus penetration via the LAN port.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

Hereinbelow, a locking apparatus for a LAN cable of the present invention will be described in detail with reference to the accompanying drawings.

Referring to FIGS. 1 to 5, when a LAN port connector 20 connected to a head-end of a LAN cable 10 is connected to a LAN port 40 provided in an electronic device, the locking apparatus for the LAN cable 100 according to the exemplary embodiment of the present invention is used to lock the LAN port connector 20 not to be disconnected from the LAN port 40 before using an authorized unlocking means.

Figure 1:
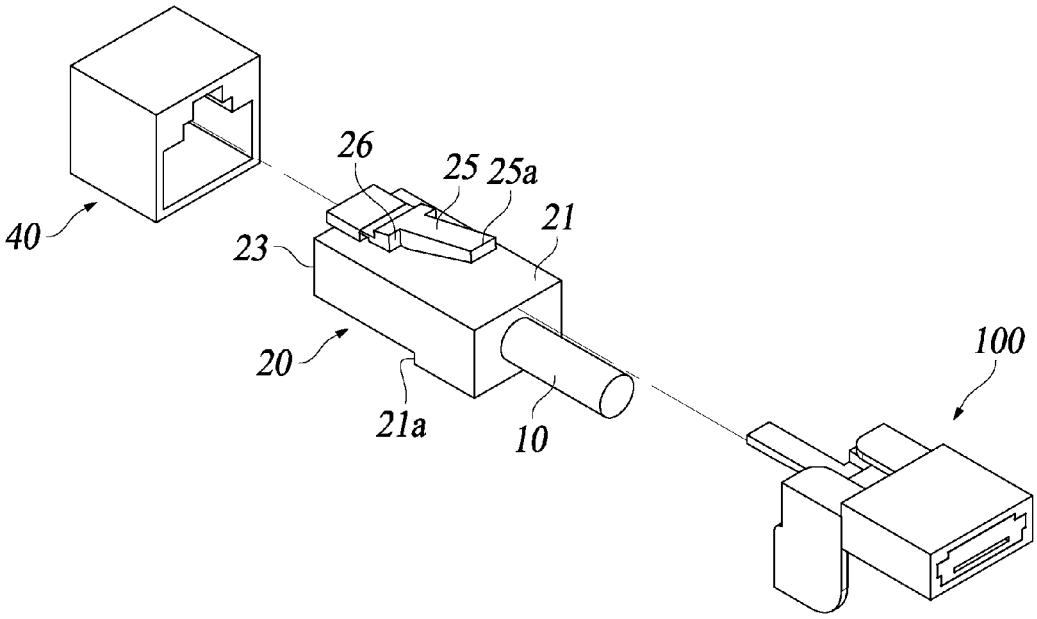
FIGS. 1 and 2 are exploded-perspective views showing a locking apparatus for a LAN cable, a LAN port, and the LAN cable according to an exemplary embodiment of the present invention.
Figure 2:
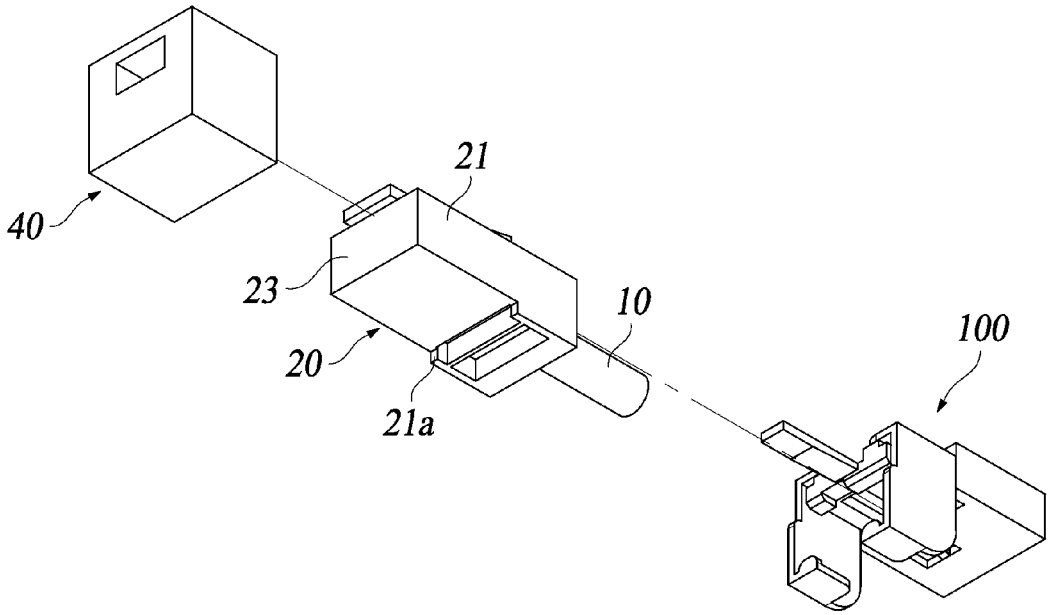

The LAN port connector 20 has a standardized structure to be inserted into and connected to the LAN port 40 standardized generally. That is, as shown in FIGS. 1 and 2, the LAN port connector 20 includes a connector body 21 to which the LAN cable 10 is inserted in a side and is connected, a connection terminal 23 that is exposed through a surface of the connector body 21, and an elastic hook 25 connected to the connector body 21 to be elastically deformable and recoverable.

A surface (a lower surface) of the connector body 21 opposite to a surface in which the elastic hook 25 is provided has a stopping step 21*a* foiled into a stepped form.

The elastic hook 25 is configured such that a first end is connected to the connector body 21, and a free end 25*a* of a second end is recovered to an original position thereof due to elasticity when a user pushes and releases the elastic hook 25 toward the connector body 21. A hook part 26 is formed into the stepped form at opposite edges of the elastic hook 25 and is hooked on a locking step (not shown) provided in an inside surface of the LAN port 40.

When the LAN port connector 20 having the above-described structure is inserted into and connected to the LAN port 40 at the beginning of the insertion, the elastic hook 25 is elastically defamed by contacting with the inside surface of the LAN port 40, and after fully inserted, the elastic hook 25 is elastically recovered again and the hook part 26 is hooked on the locking step inside the LAN port 40 in a so-called one-touch manner, whereby the LAN port connector 20 is connected to the LAN port 40 not to be removed from the LAN port 40. In order to remove the LAN port connector 20 from the LAN port 40, while pushing the free end 25*a* of the elastic hook 25 toward the connector body 21, the LAN port connector 20 may be removed by being pulled out of and the LAN port 40. That is, when the free end 25*a* of the elastic hook 25 is pushed toward the connector body 21 and elastically deformed, the hook part 26 of the elastic hook 25 is placed on a position in which the hook part 26 is not hooked on the locking step in the LAN port 40, so that the LAN port connector 20 may be removed from the LAN port 40.

Referring to FIGS. 1 to 22, the locking apparatus for the LAN cable 100 according to the embodiment of the present invention includes a connector receiving member 200, a locking apparatus body 300 coupled to the connector receiving member 200, and a locking member 400 movably installed in the locking apparatus body 300 to reciprocate.

Figure 3:
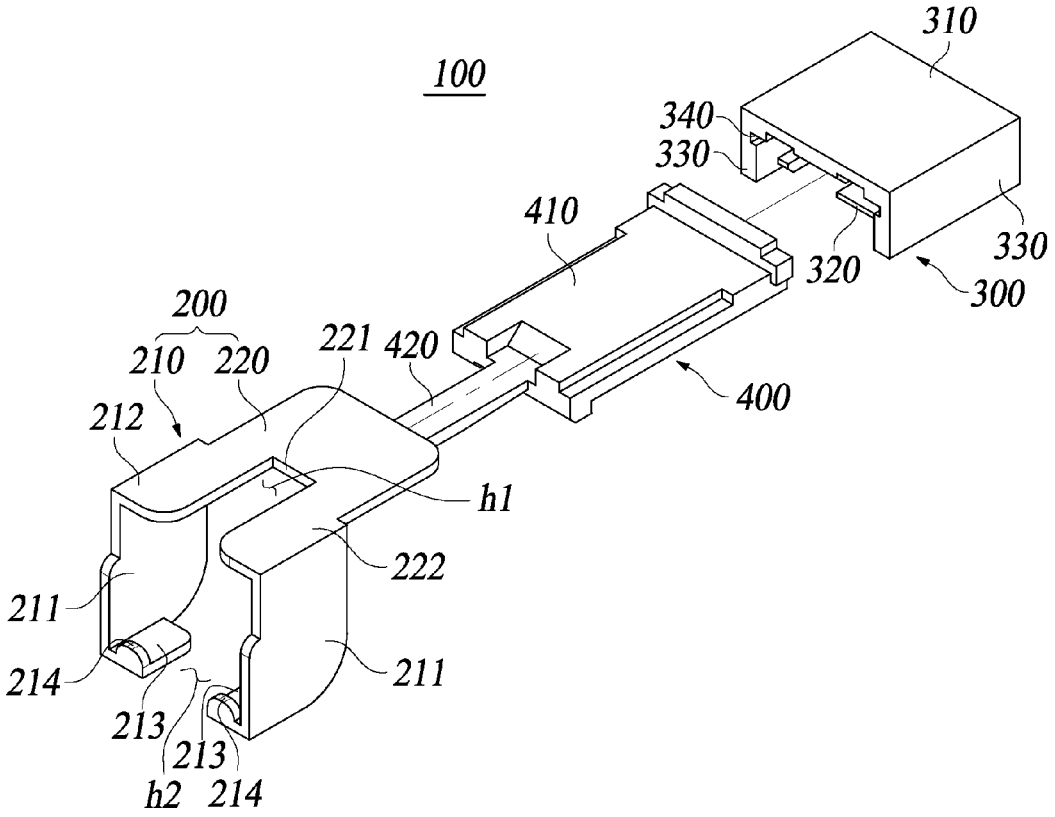
FIGS. 3 to 5 are exploded-perspective views showing the locking apparatus for the LAN cable by extracting from FIG. 1.
Figure 4:
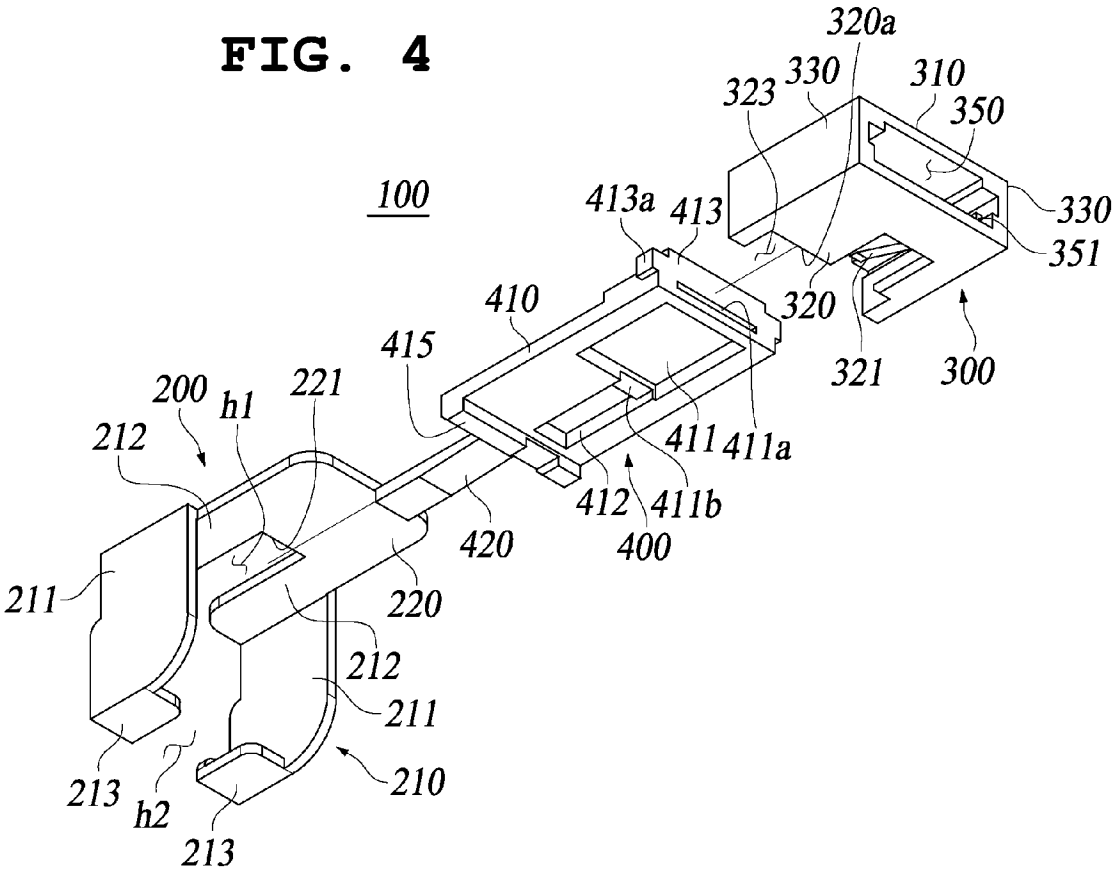
Figure 5:
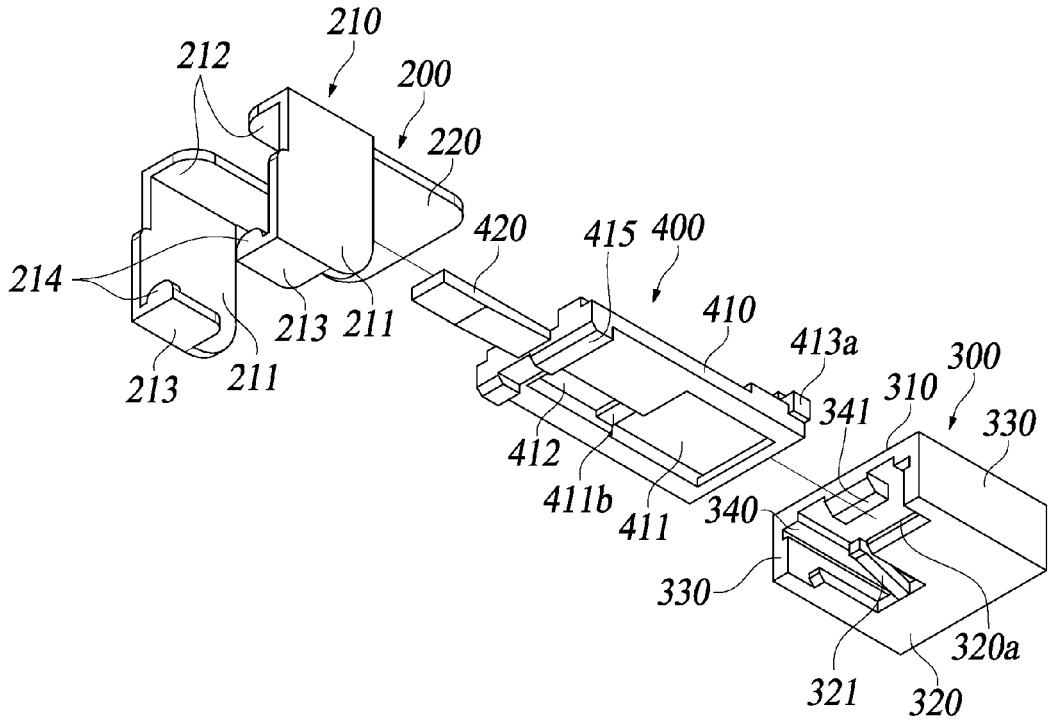

Referring to FIGS. 3 to 5, the connector receiving member 200 includes a receiving part 210 that surrounds the connector body 21 of the LAN port connector 20 and a body coupling part 220 that is connected to the receiving part 210 and coupled to the locking apparatus body 300. The receiving part 210 has opposite side walls 211 respectively corresponding to opposite side surfaces of the connector body 21, an upper wall 212 bent and extending from an upper part of each of the opposite side walls 211, and a lower wall 213 bent and extending from a lower part of the opposite side walls 211. The upper wall 212 is configured such that a pair of upper walls 212 are symmetrically connected from each of the opposite side walls 211 to each other. An open part h1 is provided between the pair of upper walls 212 and in which the elastic hook 25 of the LAN port connector 20 is positioned.

A pair of lower walls 213 extends symmetrically from each of the opposite side walls 211 to face the upper walls 212, and defines a channel h2 at the center. The LAN cable 10 may pass through the channel h2. That is, the channel h2 is provided with a size through which only the LAN cable 10 may pass, and the channel h2 is narrow so that the connector body 21 may not pass through. Accordingly, even when the LAN port connector 20 is connected to the LAN port 40 of the electronic device, the connector body 21 is accommodated in the connector receiving member 200, so the LAN port connector 20 can be easily connected to or disconnected from the LAN port 40.

In addition, the stopper 214 is provided on each lower wall 213 and is stopped by the stopping step 21*a* provided on a lower surface of the connector body 21. The stopper 214 protrudes from a head-end of the lower wall 213 toward the upper wall 212 of the receiving part 210.

Figure 8:
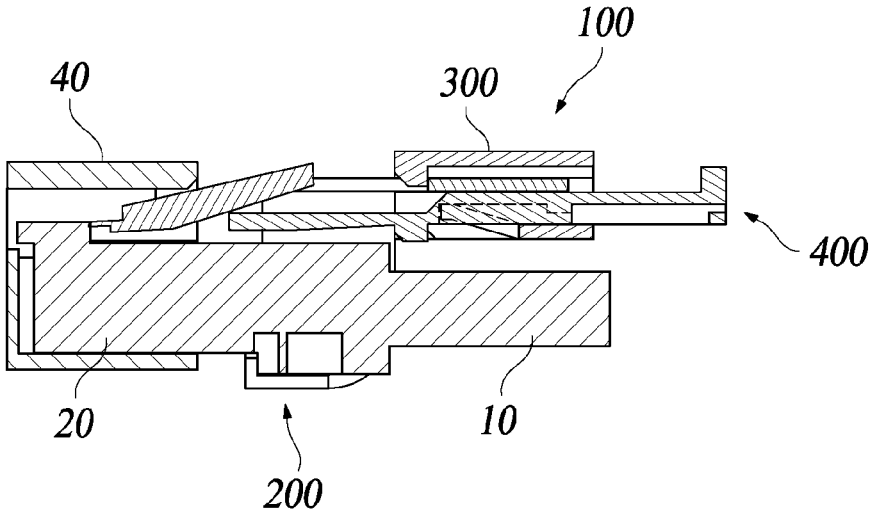
FIG. 8 is a cross-sectional view taken along line I-I of FIG. 6.
Figure 9:
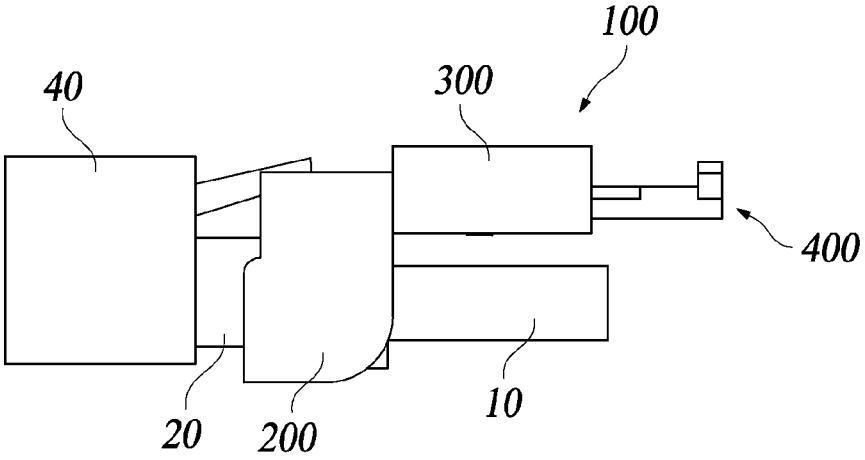
FIG. 9 is a side view of FIG. 6.
Figure 13:
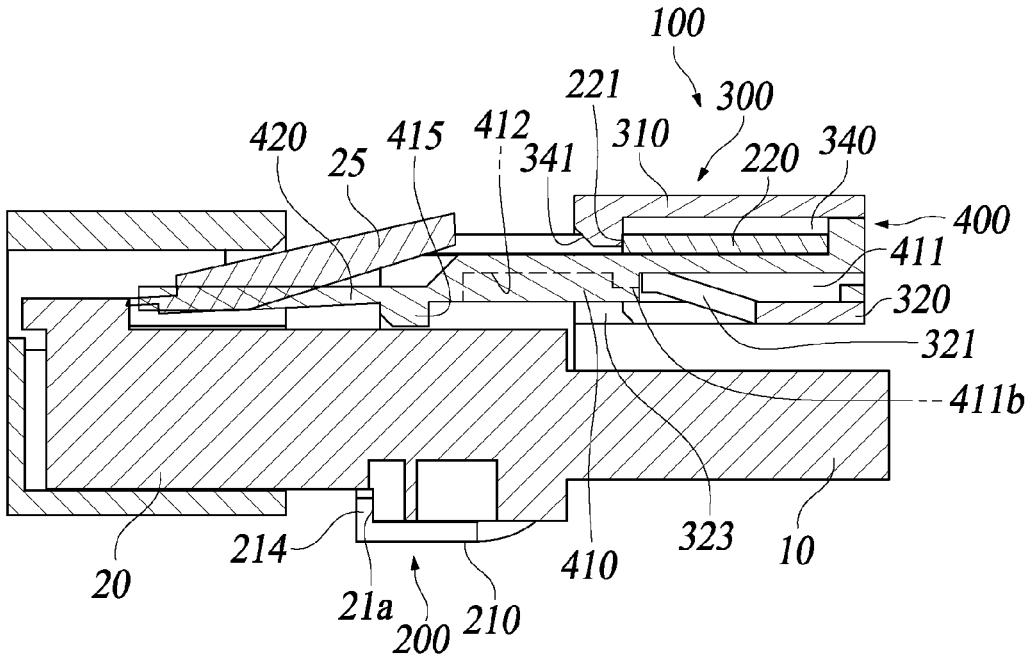
FIG. 13 is a cross-sectional view taken along line II-II of FIG. 12.
Figure 14:
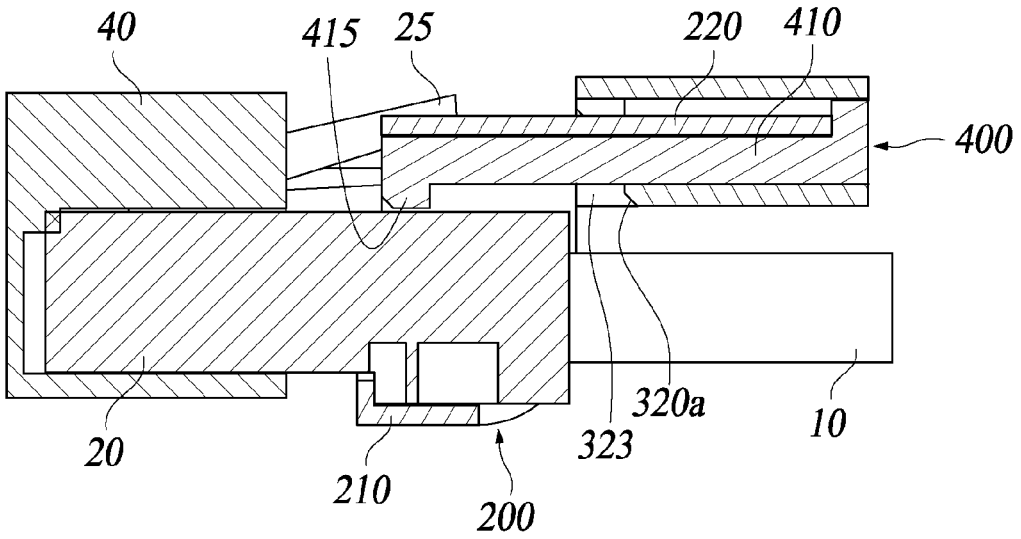
FIG. 14 is a cross-sectional view taken along line III-III of FIG. 12.
Figure 15:
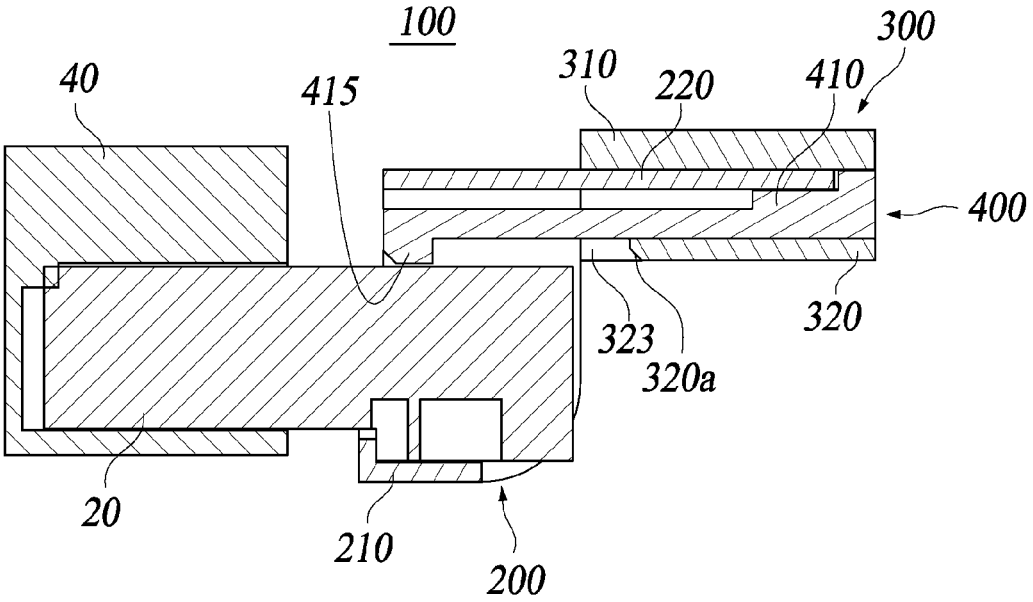
FIG. 15 is a cross-sectional view taken along line IV-IV of FIG. 12.

The body coupling part 220 protrudes to extend backward from each of the upper walls 212. The body coupling part 220 is formed into a plate shape and has a stopping step 221 exposed toward the open part h1. As shown in FIGS. 8 and 13, the body coupling part 220 is inserted into and coupled to a first coupling part 340 of the locking apparatus body 300. The stopping step 221 is stopped by a stopper 341 provided on a head-end of the first coupling part 340 and prevents the body coupling part 220 coupled to the locking apparatus body 300 from being removed from the first coupling part 340. The body coupling part 220 is preferably provided integrally with the receiving part 210.

The connector receiving member 200 having the above-described configuration is preferably famed of a metal material so as not to be easily deformed by an external force.

Referring to FIGS. 3 to 14, the locking apparatus body 300 includes an upper wall 310, a lower wall 320, and opposite side walls 330. The first coupling part 340 and a second coupling part 350 are provided between the upper wall 310 and the lower wall 320. The first coupling part 340 is provided with a predetermined depth from a front surface of the locking apparatus body 300, so the body coupling part 220 slides therein and is coupled thereto. On the inside of the upper wall 310, the above-described stopper 341 protrudes inward.

The second coupling part 350 penetrates the locking apparatus body 300 from the front to the rear. On the second coupling part 350, the locking member 400 is movably coupled to reciprocate between a locking position and an unlocking position.

Figure 6:
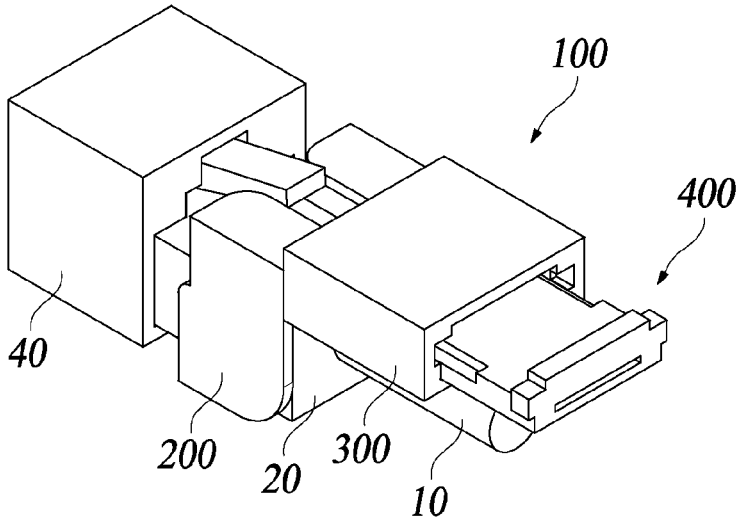
FIG. 6 is a perspective view showing a state in which the locking apparatus for the LAN cable of the present invention is coupled to a LAN port connector that is connected to the LAN port.
Figure 7:
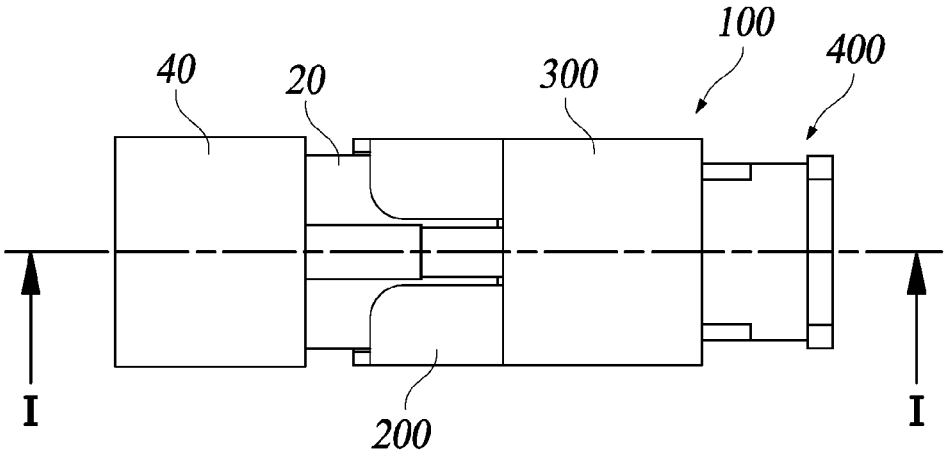
FIG. 7 is a plan view of FIG. 6.
Figure 10:
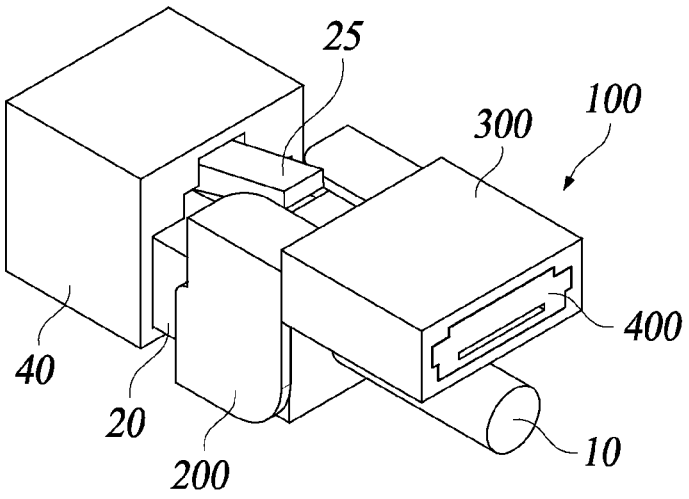
FIG. 10 is a perspective view showing a state in which a locking member in the state of FIG. 6 is moved to a locking position.
Figure 11:
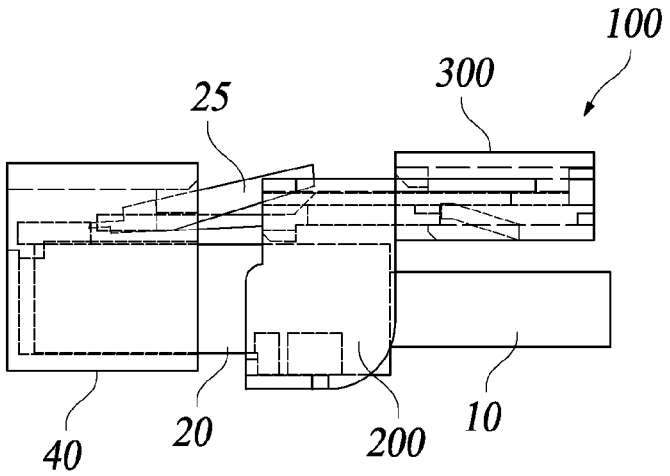
FIG. 11 is a side view of FIG. 10.
Figure 12:
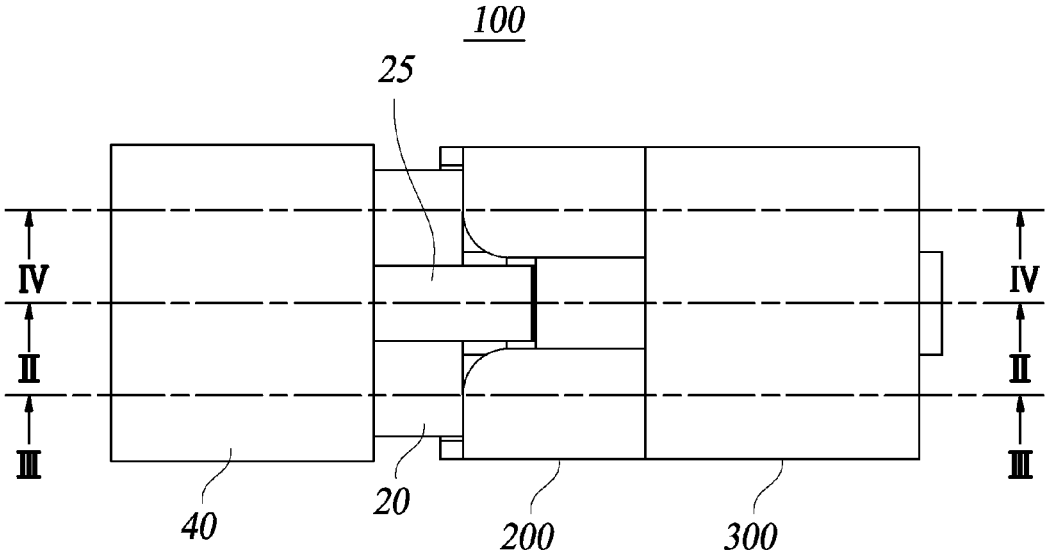
FIG. 12 is a plan view of FIG. 10.

In addition, an elastic locking member 321 is connected to the lower wall 320 to optionally restrict movement of the locking member 400. A first end of the elastic locking member 321 is connected to the lower wall 320, and a second end thereof extends to be positioned in the second coupling part 350. When the locking member 400 is positioned in the unlocking position as shown in FIGS. 6 and 8, the elastic locking member 321 remains in a deformed state by being pushed by the locking member 400. When the locking member 400 is moved to the locking position as shown in FIGS. 10 and 13, the elastic locking member 321 is elastically recovered and moved into a key way 411 provided in the locking member 400. As shown in FIG. 13, the elastic locking member 321 is stopped by a stopping step 411*b* to prevent the locking member 400 from being moving to the unlocking position.

The locking member 400 includes a locking member body 410 that is coupled to the second coupling part 350 to be slidable and reciprocable, and a hook blocking part 420 protruding forward from the locking member body 410.

The key way 411 is provided by being recessed into a lower surface of the locking member body 410. The key way 411 communicates with a key insertion opening 411*a* provided on a rear side wall 413 of the locking member body 410. In addition, a locking member receiving recess 412 is recessed on the lower surface of the locking member body 410 with the same depth as the key way 411, and connected to the key way 411. When the locking member 400 is positioned at the unlocking position, the elastic locking member 321 is positioned inside the locking member receiving recess 412. The stopping step 411*b* is provided between the locking member receiving recess 412 and the key way 411, thus preventing the elastic locking member 321 located inside the key way 411 from being moved freely from the key way 411 to the locking member receiving recess 412. The rear side wall 413 is famed in a shape of protruding respectively toward the upper and opposite sides of the locking member body 410, thus being coupled to and shutting an inlet of the second coupling part 350. A stopping step 351 is provided in the inside of the inlet of the second coupling part 350 to stop protrusions 413*a* protruding toward the opposite sides of the rear side wall 413.

In addition, a movement-preventive protrusion 415 protrudes downward from a front end of the locking member body 410. As shown in FIG. 13, when the state of moving the locking member 400 to the locking position, as the movement-preventive protrusion 415 is in close contact with an outside of the connector body 21 placed therein, the movement-preventive protrusion 415 performs a function of preventing occurrence of a gap in which the connector body 21 may be moved up and down. Accordingly, since the connector body 21 cannot be moved in the locked state, the connector body 21 and the locking apparatus for the LAN cable 100 of the present invention cannot be disconnected from each other.

In the unlocking position as shown in FIG. 8, the movement-preventive protrusion 415 is positioned in a protrusion receiving part 323 provided in a front lower part of the locking apparatus body 300. The protrusion receiving part 323 corresponds to a space that is opened to the outside by being partially removed from the lower wall 320 of the locking apparatus body 300. Therefore, the locking member 400 moved to the unlocking position has a movement distance to the unlocking position, as the movement-preventive protrusion 415 is inserted into the protrusion receiving part 323 and stopped by a head-end 320*a* of the lower wall 320.

The hook blocking part 420 protrudes to extend from the center of a head-end of the locking member body 410 by a predetermined length. The hook blocking part 420 has a sufficient length to protrude outward from the front of the connector receiving member 200. When the locking member 400 is moved to the locking position as shown in FIGS. 10 to 13, the hook blocking part 420 is moved between an upper surface of the connector body 21 and the elastic hook 25. Therefore, when the hook blocking part 420 is positioned in a lower part of the elastic hook 25 as shown in FIGS. 10 to 13, the elastic hook 25 is prevented from being pushed toward the connector body 21. Accordingly, the LAN port connector 20 can remain the locked state so that the LAN port connector 20 is not removed from the LAN port 40.

Hereinafter, the locking apparatus for the LAN cable 100 according to the embodiment of the present invention having the above-described configuration will be described in detail, focusing on operational effects.

First, as shown in FIGS. 1 and 2, the LAN port connector 20 of the LAN cable 10 is inserted into the LAN port 40 of the electronic device. Next, the locking apparatus for the LAN cable 100 of the present invention may be sequentially coupled to the LAN port connector 20.

Figure 16:
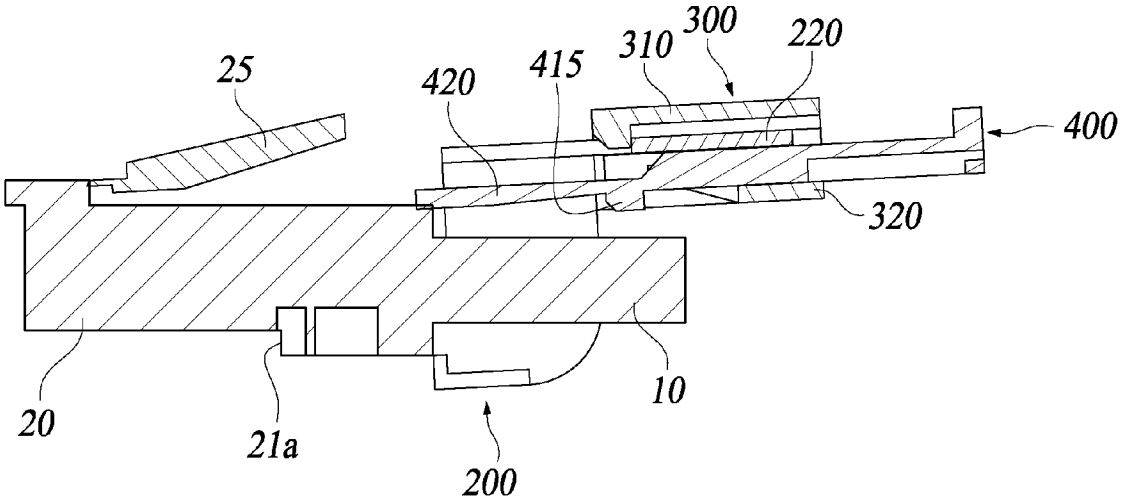
FIGS. 16 and 17 are schematic views each showing a process of coupling a connector body to a connector receiving member.
Figure 17:
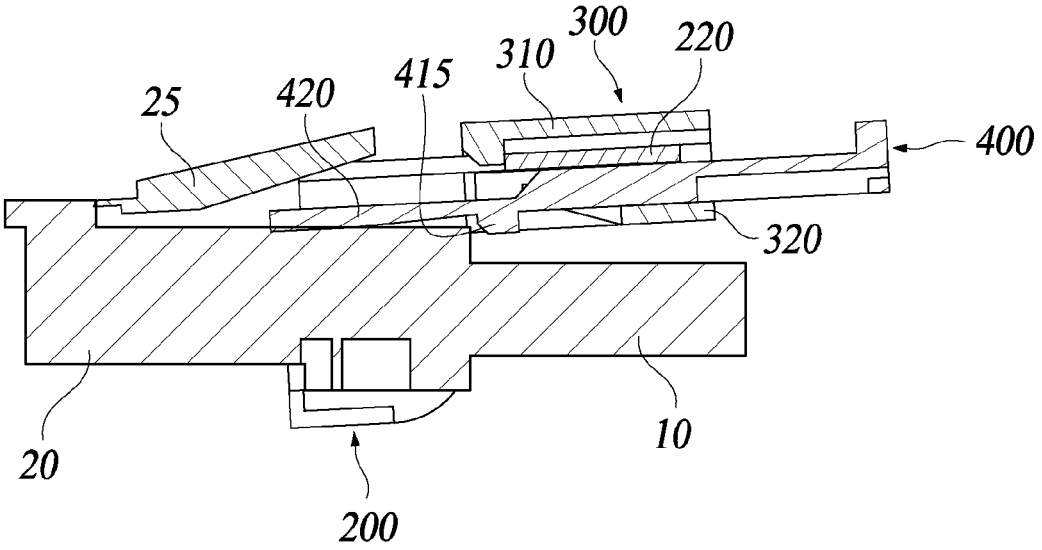

That is, as shown in FIG. 16, when the LAN port connector 20 is connected to the LAN port 40, the connector body 21 is inserted into the inside of the connector receiving member 200 by tilting a position of the connector receiving member 200. As the connector body 21 is inserted into the connector receiving member 200 with tilting the connector receiving member 200 as described above, the stopper 214 passes over the stopping step 21*a* of the connector body 21, as shown in FIG. 17. In this state, when the position of the connector receiving member 200 is corrected and the connector receiving member 200 is coupled to the connector body 21, the stopper 214 is stopped by the stopping step 21*a* as shown in FIG. 8, so that the connector receiving member 200 and the LAN port connector 20 are coupled to each other not to be disconnected from each other.

Like above description, coupling the connector receiving member 200 to the LAN port connector 20 proceeds after moving the locking member 400 from the locking apparatus body 300 to the unlocking position. In addition, since the channel h2 is provided in the lower part of the connector receiving member 200 so that the LAN cable 10 can pass through, the LAN port connector 20 and the connector receiving member 200 can be easily coupled to each other without disconnection of the LAN port connector 20 from the LAN port 40.

When the connector receiving member 200 is coupled to the LAN port connector 20, the locking member 400 is pushed into the inside of the locking apparatus body 300 as shown in FIGS. 10 to 15. Then, the elastic locking member 321 is inserted into the key way 411 and is stopped by the stopping step 411*b* thereby locking the locking member 400 so that the locking member 400 is not removed. In addition, the hook blocking part 420 is inserted between the upper surface of the connector body 21 and the elastic hook 25. When the hook blocking part 420 is positioned between the upper surface of the connector body 21 and the elastic hook 25, by preventing the elastic hook 25 from being deformed by being pushed toward the connector body 21, the LAN port connector 20 can be removed from the LAN port 40. In addition, when the locking member 400 is moved to the locking position, the movement-preventive protrusion 415 is in close contact with the upper surface of the connector body 21, and an upper surface of the locking member 400 remains in a contacted state with the upper wall of the connector receiving member 200. Thus, in the connector receiving member 200, the connector body 21 cannot be moved or position thereof cannot be deformed, so a firmly coupled state of the connector body 21 can be maintained. When the LAN port connector 20 connected to the LAN port 40 is coupled and locked using the locking apparatus for the LAN cable 100 of the present invention, the LAN cable cannot be removed from the electronic device. Thus connection of unauthorized connectors to the LAN port 40 can be effectively blocked, and security of the electronic device can be improved.

Figure 18:
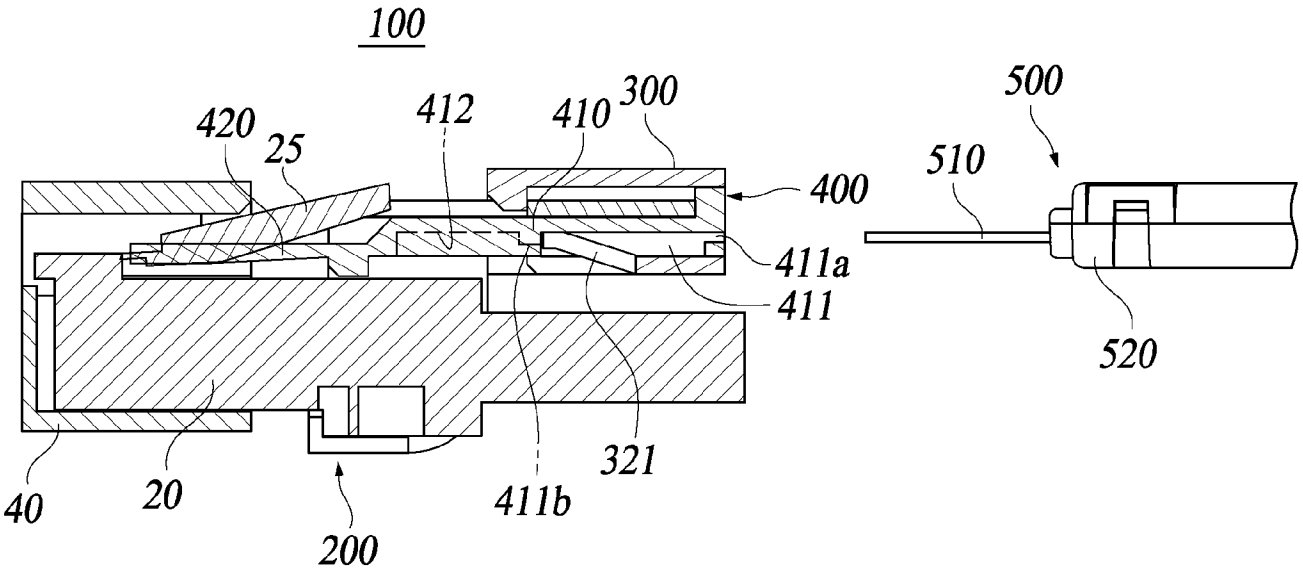
FIG. 18 is a cross-sectional view showing a state before inserting an unlocking key member into a key way.
Figure 19:
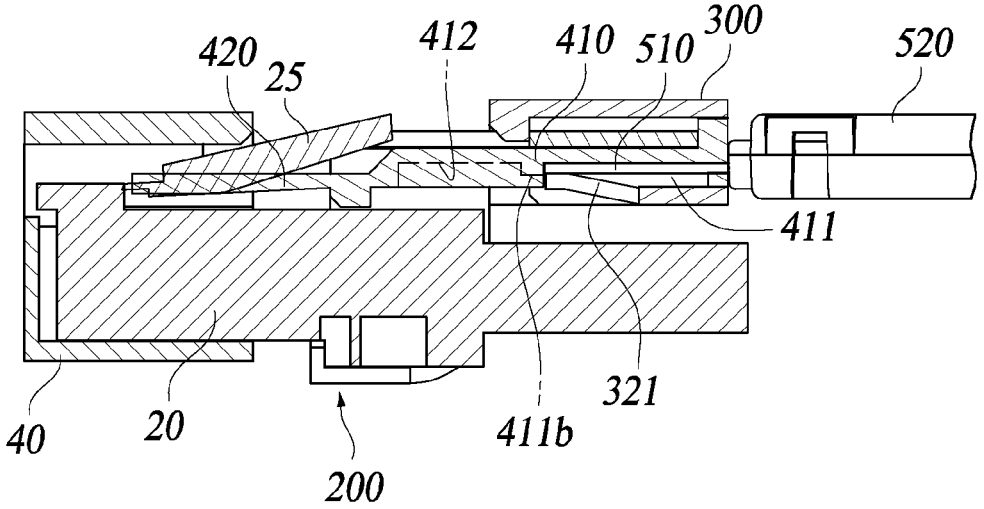
FIG. 19 is a cross-sectional view showing a state of inserting the unlocking key into the key way for illustrating the state of FIG. 18.
Figure 20:
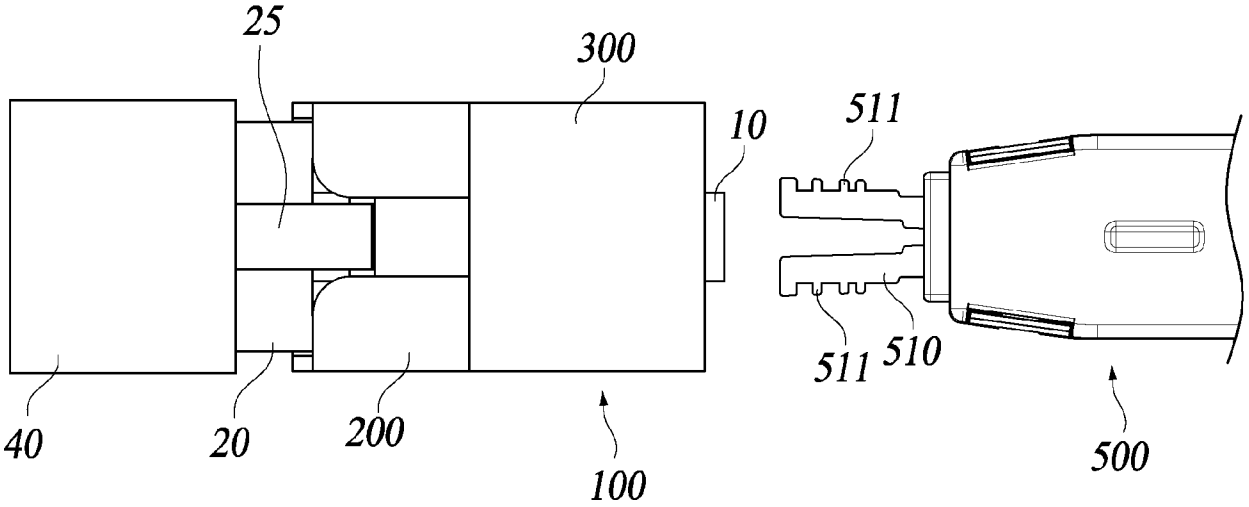
FIG. 20 is a plan view of FIG. 18.
Figure 21:
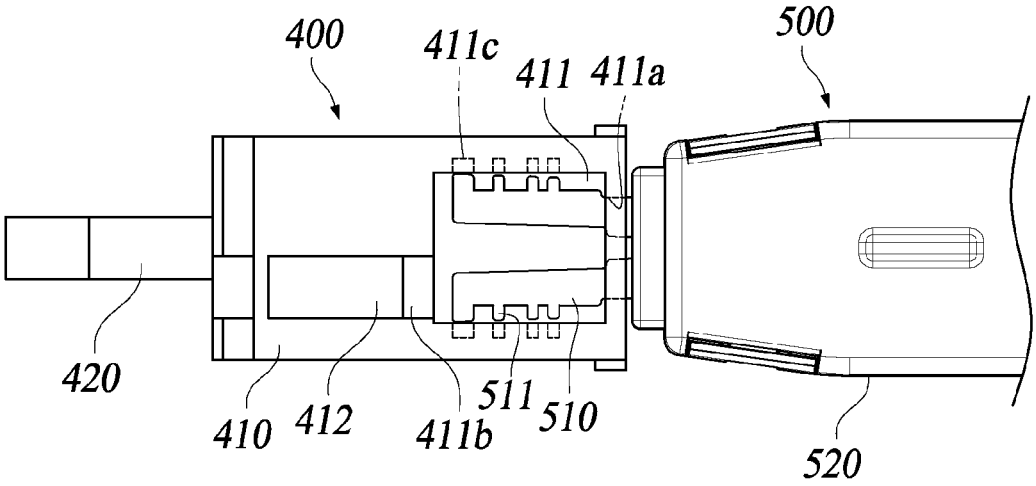
FIG. 21 is a bottom view showing the locking member for illustrating the state of FIG. 19.

Meanwhile, as described above, in order to remove the LAN port connector 20 that is locked by the locking apparatus for the LAN cable 100 from the LAN port 40, first, the locking member 400 should be moved to the unlocking position. To do this, as shown in FIGS. 18 and 20, an unlocking key member 500 inserted into the key way 411 is prepared, and the unlocking key 510 of the unlocking key member 500 is inserted into the key way 411 via the key insertion opening 411*a* as shown in FIGS. 19 and 21. Then, the unlocking key 510 inserted in the key way 411 interferes with the elastic locking member 321 so that the elastic locking member 321 is released from the stopping step 411*b* of the key way 411.

Figure 22:
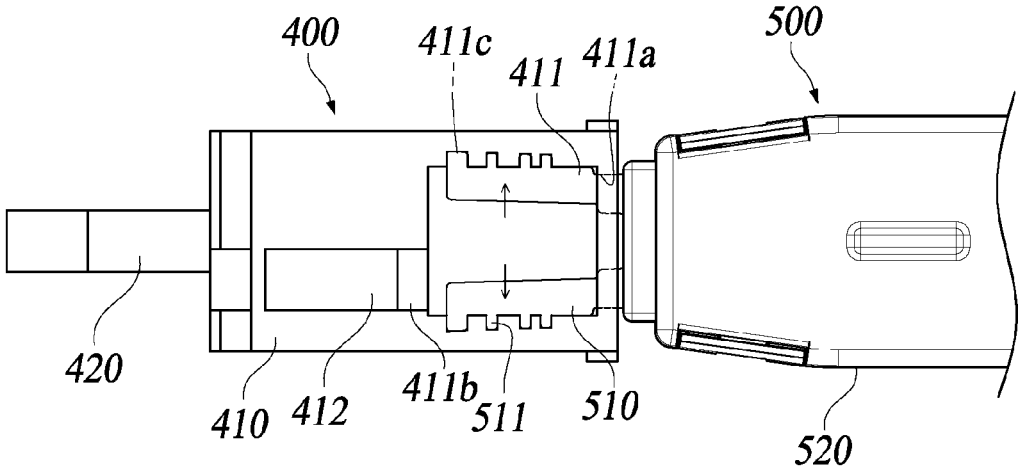
FIG. 22 is a bottom view showing a state in which the unlocking key is opened in the state of FIG. 21.
Figure 23:
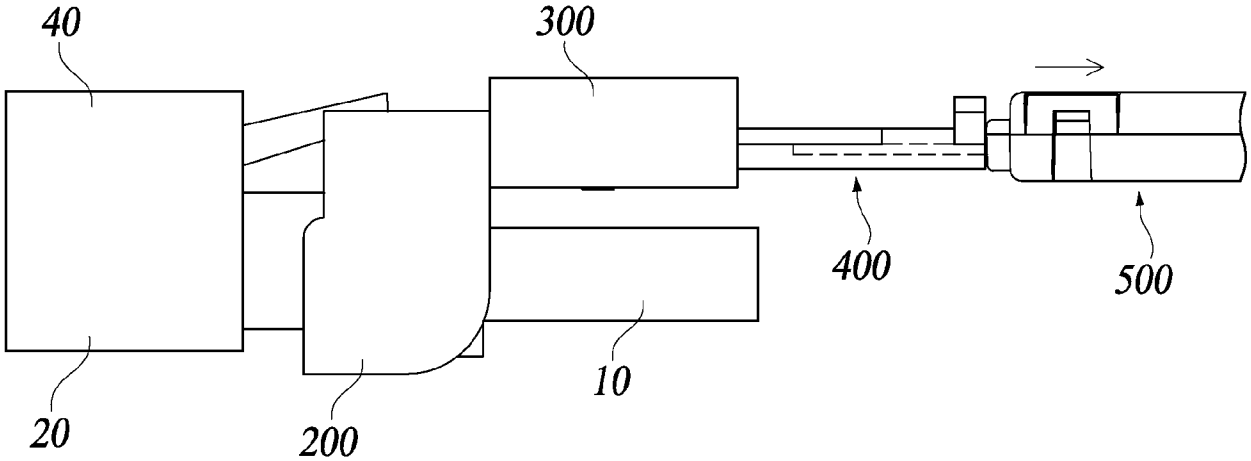
FIG. 23 is a side view showing a state in which the locking member is moved to an unlocking position using the unlocking key.

When the unlocking key 510 provided with a pair of keys is opened in the key way 411 as shown in FIG. 21, a key pattern 511 famed an outside of the unlocking key 510 is engaged with a corresponding pattern groove 411*c* formed on an inner wall of the key way 411 as shown in FIG. 22. When pulling the unlocking key member 500 in this state, the locking member 400 engaged with the unlocking key 510 is removed from the locking apparatus body 300 as shown in FIG. 23. Then, after the hook blocking part 420 is disconnected from the elastic hook 25 as shown in FIG. 8, the movement-preventive protrusion 415 is released from an upper part of the connector body 21 and moved toward the locking apparatus body 300. Accordingly, since the connector receiving member 200 is movable against the LAN port connector 20, the locking apparatus for the LAN cable 100 can be disconnected from the LAN cable.

In addition, as the elastic hook 25 of the LAN port connector 20 is manipulated, the LAN port connector 20 can be disconnected from the LAN port 40.

Meanwhile, the unlocking key member 500 has the pair of unlocking keys 510 protruding from an unlocking key member body 520 as a head-end.

The pair of unlocking keys 510 may be opened or closed by manipulating a disconnecting operation knob provided in the unlocking key member body 520. In addition, on the outside of the unlocking key 510, the key pattern 511 is famed into a predetermined pattern, and the key pattern 511 has a form corresponding to the pattern groove 411*c* famed on the inner wall of the key way 411 of the locking member 400. The key pattern 511 may be formed into various forms. The specific configuration of the above-described unlocking key member 500 is not limited to the description of the present invention, and detailed description thereof will be omitted. That is, the unlocking key member 500 can apply various known unlocking key members.

Although the preferred embodiment of the present invention has been described for illustrative purposes, the present invention is not limited to the embodiment described hereinabove. Those skilled in the art will appreciate that various modifications, additions and substitutions are possible, without departing from the scope and spirit of the invention as disclosed in the accompanying claims. Therefore, the modifications or equivalents should not be understood individually from the technical spirit or viewpoint of the present invention, the modified embodiments belong to the claims of the present invention.

What is claimed is:

1. A locking apparatus for a LAN cable, the locking apparatus comprising:

a connector receiving member receiving a LAN port connector to be coupled thereto, the LAN port connector having a connector body, an elastic hook provided in an upper part of the connector body, and a stopping step provided in a lower part of the connector body;

a locking apparatus body coupled to the connector receiving member; and a locking member disturbing operation of the elastic hook of the LAN port connector in the locking apparatus body, and movably installed to reciprocate between a locking position in which disconnecting operation of the connector receiving member and the LAN port connector is unattainable, and a unlocking position in which release operation of the elastic hook is enabled and the disconnecting operation of the connector receiving member is enabled;

wherein the locking member is provided with a key way into which an unlocking key is inserted.

2. The locking apparatus for the LAN cable of claim 1, wherein the connector receiving member comprises:

a receiving part for surrounding and receiving an outside of the connector body of the LAN port connector; and a body coupling part extending from the receiving part and coupled to the locking apparatus body;

wherein the receiving part comprises:

opposite side walls facing each other;

a pair of upper walls symmetrically connected to each other while facing each other at upper parts of the opposite side walls, and having an open part in which the elastic hook is positioned; and a pair of lower walls symmetrically connected to each other while facing each other, and spaced apart from each other to define a channel through which a cable connected to the LAN port connector passes.

3. The locking apparatus for the LAN cable of claim 2, wherein the receiving part further comprises:

a stopper protruding from each of the lower walls toward an associated upper wall and stopped by the stopping step of the LAN port connector.

4. The locking apparatus for the LAN cable of claim 1, wherein the locking apparatus body comprises an upper wall, a lower wall, opposite side walls, and an elastic locking member protruding to extend from the lower wall to the upper wall, locking the locking member by being inserted into the key way of the locking member, and unlocking the locking member by being removed from the key way by the unlocking key inserted into the key way, wherein between the upper wall and lower wall, a first coupling part to which the connector receiving member is coupled and a second coupling part to which the locking member is movably coupled to reciprocate are provided.

5. The locking apparatus for the LAN cable of claim 1, wherein the locking member comprises:

a locking member body retracting into and coming out of the locking apparatus body, and having a movement-preventive protrusion filling a gap between the LAN port connector and the connector receiving member at the locking position; and a hook blocking part extending from the locking member body, and positioned between the elastic hook and the connector body of the LAN port connector at the locking position to block deformation of the elastic hook.

6. The locking apparatus for the LAN cable of 5, wherein the connector receiving member comprises:

a receiving part for surrounding and receiving an outside of the connector body of the LAN port connector; and a body coupling part extending from the receiving part and coupled to the locking apparatus body;

wherein the receiving part comprises:

opposite side walls facing each other;

a pair of upper walls symmetrically connected to each other while facing each other at upper parts of the opposite side walls, and having an open part in which the elastic hook is positioned; and a pair of lower walls symmetrically connected to each other while facing each other, and spaced apart from each other to define a channel through which a cable connected to the LAN port connector passes.

7. The locking apparatus for the LAN cable of claim 6, wherein the receiving part further comprises:

a stopper protruding from each of the lower walls toward an associated upper wall and stopped by the stopping step of the LAN port connector.

8. The locking apparatus for the LAN cable of claim 5, wherein the locking apparatus body comprises an upper wall, a lower wall, opposite side walls, and an elastic locking member protruding to extend from the lower wall to the upper wall, locking the locking member by being inserted into the key way of the locking member, and unlocking the locking member by being removed from the key way by the unlocking key inserted into the key way, wherein between the upper wall and lower wall, a first coupling part to which the connector receiving member is coupled and a second coupling part to which the locking member is movably coupled to reciprocate are provided.

* * * * *